US006547009B2

(12) United States Patent
Vick, Jr.

(10) Patent No.: US 6,547,009 B2
(45) Date of Patent: Apr. 15, 2003

(54) LOW PROFILE STATIC WELLHEAD PLUG

(75) Inventor: James D. Vick, Jr., Dallas, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 73 days.

(21) Appl. No.: 09/949,740

(22) Filed: Sep. 10, 2001

(65) Prior Publication Data

US 2003/0047324 A1 Mar. 13, 2003

(51) Int. Cl.[7] ..... E21B 33/03

(52) U.S. Cl. ..... 166/368; 166/386; 166/135; 166/387; 166/123; 166/181; 166/192

(58) Field of Search ..... 166/386, 75.13, 166/135, 88.1, 89.3, 95.1, 368, 123, 181, 192, 387

(56) References Cited

U.S. PATENT DOCUMENTS

| | | | |
|---|---|---|---|
| 3,143,170 A | | 8/1964 | Nelson |
| 3,602,303 A | | 8/1971 | Blenkarn et al. |
| 4,007,783 A | * | 2/1977 | Amancharla et al. |
| 4,051,897 A | | 10/1977 | Kingelin |
| 4,796,698 A | * | 1/1989 | Gano |
| 4,928,761 A | | 5/1990 | Gazda et al. |
| 5,080,174 A | | 1/1992 | Hynes |
| 5,318,117 A | | 6/1994 | Echols, III et al. |
| 5,398,764 A | | 3/1995 | Collins |
| 5,509,476 A | | 4/1996 | Vick, Jr. |
| 5,542,475 A | | 8/1996 | Turner et al. |
| 5,555,935 A | | 9/1996 | Brammer et al. |
| 5,617,918 A | | 4/1997 | Cooksey et al. |
| 5,875,851 A | | 3/1999 | Vick, Jr. et al. |
| 5,957,201 A | | 9/1999 | Vick, Jr. et al. |
| 5,988,277 A | | 11/1999 | Vick, Jr. et al. |
| 5,996,697 A | | 12/1999 | Vick et al. |

FOREIGN PATENT DOCUMENTS

| | | |
|---|---|---|
| GB | 2002838 A | 2/1979 |
| GB | 2312455 A | 10/1997 |

OTHER PUBLICATIONS

SSR Catalog (7 pages), entitled "SSR Horizontal Tree Isolation Plug", undated (Dated subsequent to Jan. 1998).

* cited by examiner

*Primary Examiner*—Roger Schoeppel
(74) *Attorney, Agent, or Firm*—Marlin R. Smith

(57) ABSTRACT

A plug is provided for use in conjunction with a subterranean well. In a described embodiment, a wellhead plug includes multiple outwardly extendable lugs for engagement with corresponding multiple oppositely facing shoulders formed internally on a bore extending in a wellhead. The lugs engage the shoulders to thereby resist pressure applied to the plug in the bore from above or below.

46 Claims, 2 Drawing Sheets

FIG. 1
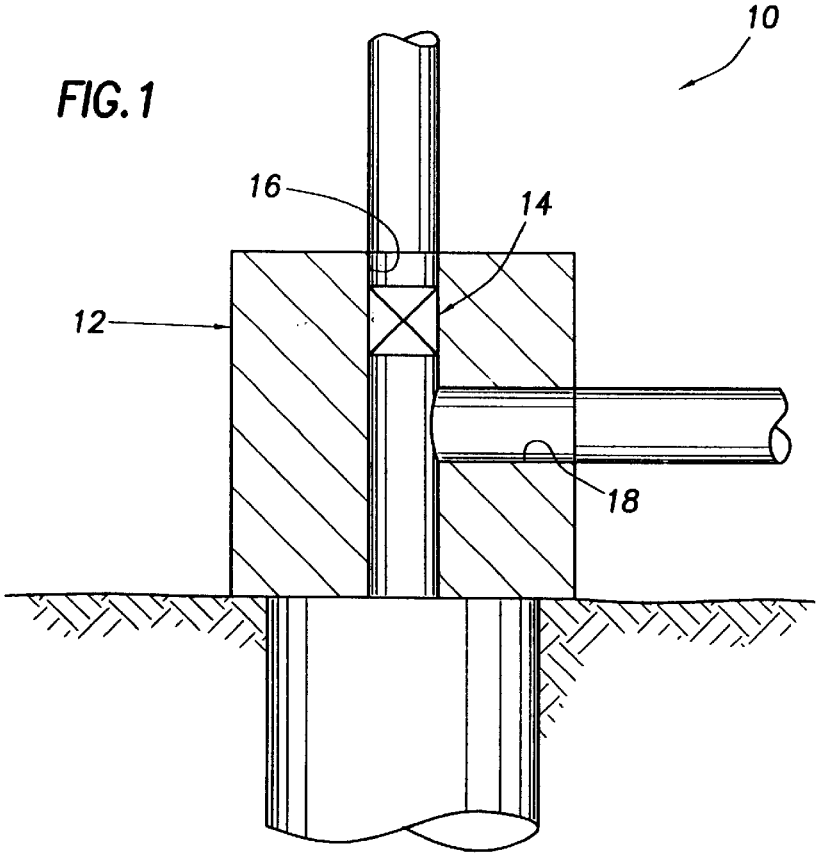
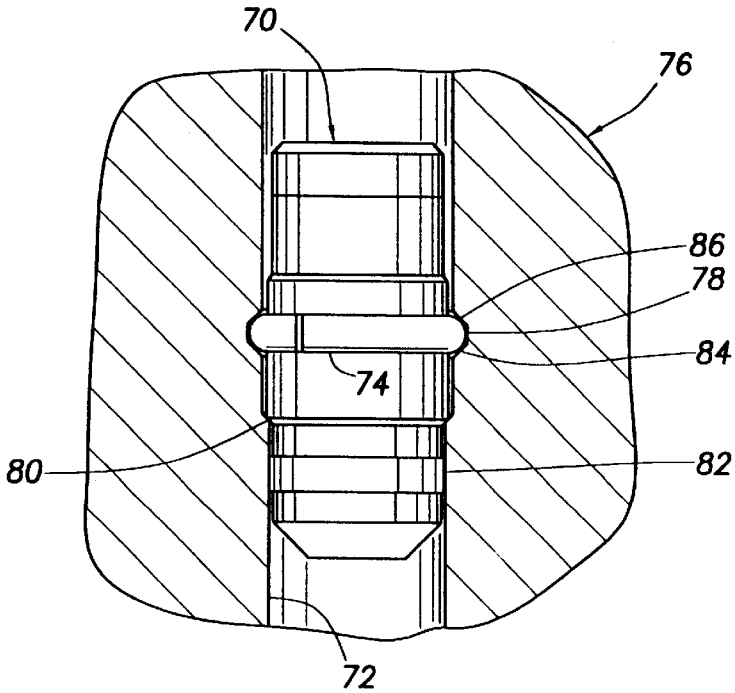
FIG. 3

LOW PROFILE STATIC WELLHEAD PLUG

BACKGROUND

The present invention relates generally to equipment utilized in conjunction with a subterranean well and, in an embodiment described herein, more particularly provides a low profile static wellhead plug.

Wellhead plugs which utilize metal to metal seals are well known in the art. It is also well known that relative motion between sealed surfaces in a metal to metal seal is undesirable, for example, because such motion may cause fretting of the metal surfaces, thereby causing the seal to leak. Therefore, a wellhead plug utilizing a metal to metal seal is preferably "static", meaning that there is no displacement of its seal in response to pressure applied to the wellhead.

Prior static wellhead plugs are rated for relatively high pressures applied from below, but are rated for relatively low pressures applied from above. A typical wellhead plug uses relatively large lugs engaged with a large profile formed internally in the wellhead to resist high pressure from below. However, the typical static wellhead plug is supported on a small no-go shoulder formed internally in the wellhead. The small shoulder is capable of resisting only relatively low pressures applied to the plug from above. Higher pressures would cause the shoulder material to yield, damaging the plug and/or wellhead, enabling the plug to displace and possibly causing the seal to leak.

To prevent this problem, the no-go shoulder could be increased in size so that higher pressures could be applied to the plug from above, but that would require a smaller drift diameter through the wellhead, or would require a larger overall wellhead, and a larger riser in subsea applications. Neither of these options is desirable, since the former would reduce the bore through the wellhead, and the letter would increase the cost of the wellhead, the riser and their installation.

Therefore, it will readily be appreciated that a need exists for a static wellhead plug which is capable of resisting high pressures from above, as well as from below, which can successfully utilize a metal to metal seal, but which does not require a reduction of a wellhead drift diameter or an enlargement of the wellhead or riser.

In carrying out the principles of the present invention, in accordance with an embodiment thereof, a wellhead plug system is provided which addresses the above problems in the art. The system has a low profile which does not require an enlargement of the wellhead or a reduction of its internal bore, while allowing relatively high pressures to be resisted from above or below.

In one aspect of the present invention, a wellhead plug system is provided which includes a specially adapted wellhead and a corresponding specially constructed wellhead plug. The wellhead has first and second oppositely facing shoulders internally formed on a bore extending through the wellhead. The plug is sealingly received in the bore. A metal to metal seal may be used to seal between the plug and bore.

The plug includes at least one outwardly extendable lug engaging the first shoulder and preventing displacement of the plug relative to the bore in one direction, and at least one outwardly extendable lug engaging the second shoulder and preventing displacement of the plug relative to the bore in an opposite direction. To keep the plug motionless in the bore, the first lug engages the first shoulder while the second lug is engaged with the second shoulder.

Preferably, the lugs are biased into contact with the shoulders so that compression or tension is induced in the plug between the lugs. This is accomplished in one embodiment by maintaining one lug in contact with a shoulder while another lug is biased into contact with another shoulder. The shoulders are laterally inclined, so this biasing contact wedges the lugs between the shoulders, thereby compressing a portion of the plug between the lugs. Other embodiments could induce tension in the plug between the lugs.

Instead of separate lugs for contacting opposing shoulders in the wellhead, the plug could use one or more lugs, each of which contacts both of the opposing shoulders. In this manner, each lug would act to prevent movement of the plug in both directions relative to the wellhead. Lugs utilized with the invention may have a variety of shapes, including polygonal, circular, etc.

These and other features, advantages, benefits and objects of the present invention will become apparent to one of ordinary skill in the art upon careful consideration of the detailed description of representative embodiments of the invention hereinbelow and the accompanying drawings.

BRIEF DESCRIPTION OF THE DRAWINGS

FIG. 1 is a schematic cross-sectional view of a first wellhead plug embodying principles of the present invention, the first wellhead plug being shown installed in a wellhead;

FIG. 3 is a schematic elevational view of a second wellhead plug embodying principles of the present invention, the second wellhead plug being shown installed in a wellhead depicted in cross-section.

DETAILED DESCRIPTION

Figure 2:
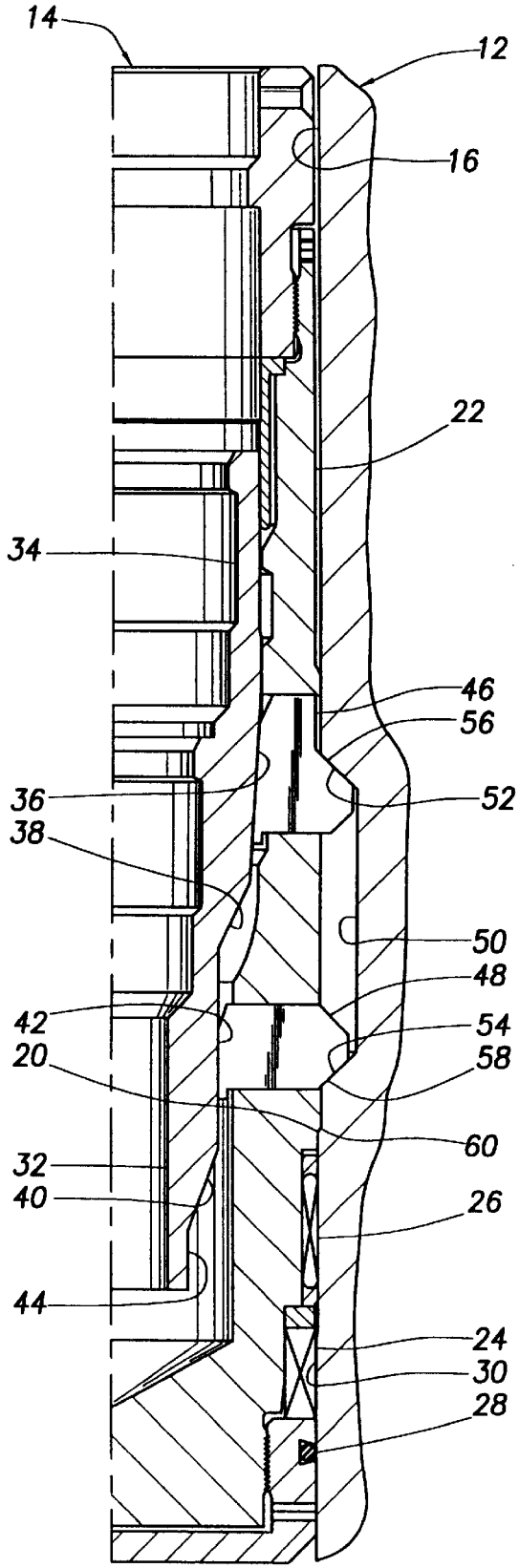
FIG. 2 is an enlarged scale quarter-sectional view through the first wellhead plug.

Representatively illustrated in FIG. 1 is a wellhead plug system 10 which embodies principles of the present invention. In the following description of the system 10 and other apparatus and methods described herein, directional terms, such as "above", "below", "upper", "lower", etc., are used only for convenience in referring to the accompanying drawings. Additionally, it is to be understood that the embodiment of the present invention described herein may be utilized in various orientations, such as inclined, inverted, horizontal, vertical, etc., and in various configurations, without departing from the principles of the present invention.

The system 10 as depicted in FIG. 1 includes a wellhead 12 having a wellhead plug 14 installed therein. In this embodiment, the plug 14 is installed in a bore 16 extending vertically through the wellhead 12. However, the plug 14 could also be used in other types of bores, such as a horizontal bore 18 intersecting the vertical bore 16, etc.

To install the plug 14, the plug is lowered into the bore 16 until it rests on a relatively small no-go shoulder 20 (not visible in FIG. 1, see FIG. 2). The plug 14 is then set in the wellhead 12 using a running tool (not shown) of the type well known to those skilled in the art.

Preferably, the plug 14 seals against the bore 16 utilizing a metal to metal seal, thereby blocking fluid flow through the bore and resisting pressure differentials across the plug. In a unique aspect of the plug 14 embodying principles of the present invention, the plug is static relative to the bore 16 whether a pressure differential is applied across the plug from above or below, and remains static even when the pressure differential is relatively high from above.

Referring additionally now to FIG. 2, the plug 14 is representatively illustrated in enlarged cross-section. The plug 14 is shown installed and set within the wellhead 12. It is to be clearly understood, however, that the plug 14 could be installed in another item of equipment, without departing from the principles of the invention.

The plug 14 includes an outer housing assembly 22 on which is carried a primary seal 24, a secondary seal 26 and a wiper or debris barrier 28. The primary seal 24 is preferably a metal to metal seal, of the type well known to those skilled in the art, for sealing between the housing 22 and a seal bore 30. The secondary seal 26 is preferably a packing stack, e.g., utilizing chevron-type packing. Of course, any other types of seals may be used for the seals 24, 26, the seals may be otherwise positioned, and any number of seals may be used on the plug, in keeping with the principles of the invention.

A generally tubular mandrel 32 is reciprocably received within the housing assembly 22. The mandrel 32 has an internal profile 34 formed thereon for engagement by the running tool (not shown), which is used to convey the plug 14 into the wellhead 12, and to displace the mandrel relative to the housing assembly 22. As depicted in FIG. 2, the mandrel 32 is in its downwardly displaced position relative to the housing assembly 22, the running tool having displaced the mandrel downward after the plug 14 was conveyed into the wellhead 12 and engaged with the no-go shoulder 20.

The mandrel 32 has three conical-shaped or tapered surfaces 36, 38, 40 formed externally thereon, and two cylindrical surfaces 42, 44 formed externally thereon. In the downwardly displaced position depicted in FIG. 2, an upper key or lug 46 contacts the tapered surface 36, and a lower key or lug 48 contacts the cylindrical surface 42. However, when the plug 14 is conveyed into the wellhead 12, the mandrel 32 is in an upwardly displaced position in which the upper lug 46 is opposite the cylindrical surface 42 and the lower lug 48 opposite the cylindrical surface 44.

As used herein, the term "key" or "lug" is used to indicate a member which extends from a plug to engage a profile formed in a wellhead for the purpose of limiting displacement of the plug in the wellhead. Keys and lugs can have any shape for cooperative engagement with any profile shape. The lugs 46, 48 described herein are polygonal in cross-section, but other types of lugs, such as the circular cross-section C-ring 74 described below may also be used, and any other type of lug may be used, without departing from the principles of the invention.

It will be readily appreciated that, when the plug 14 is conveyed into the wellhead 12, the mandrel 32 is in its upwardly displaced position and the lugs 46, 48 are opposite the respective surfaces 42, 44, the lugs will be able to inwardly retract from their positions as depicted in FIG. 2. In fact, the sequence of steps in installing the plug 14 in the wellhead 12 is as follows: 1) with the mandrel 32 in its upwardly displaced position and the lugs 46, 48 inwardly retracted (the lugs being opposite the cylindrical surfaces 42, 44 on the mandrel), the plug is lowered in to the bore 16; 2) an external shoulder 60 formed on the housing assembly 22 contacts the no-go shoulder 20, thereby supporting the plug against further downward movement in the bore; and 3) the mandrel 32 is downwardly displaced by the running tool to its position as depicted in FIG. 2, thereby forcing the lugs outward into engagement with a profile 50 formed internally on the wellhead.

The lower lug 48 is forced outward because the surface 42 has a larger diameter than the surface 44. The surface 40 is laterally inclined to aid in displacing the lug 48 radially outward as the mandrel 32 displaces from its upward to its downwardly displaced position.

The upper lug 46 is forced outward because the surface 36, even at its smallest outer diameter, has a larger diameter than the surface 42. The surface 38 is laterally inclined to aid in displacing the lug 46 radially outward as the mandrel 32 displaces from its upward to its downwardly displaced position. Note, however, that since the surface 36 is laterally inclined, the upper lug 46 may be biased further outward by further downward displacement of the mandrel 32. Thus, the upper lug 46 may displace outward independently of the lower lug 48.

The profile 50 has oppositely facing laterally inclined shoulders 52, 54 formed thereon. A complementarily shaped shoulder 56 formed on the upper lug 46 engages the shoulder 52, and a complementarily shaped shoulder 58 formed on the lower lug 48 engages the shoulder 54, when the lugs are outwardly extended from the housing assembly 22 by downwardly displacing the mandrel 32. The engagement between the no-go shoulder 20 and the external shoulder 60 aligns the upper lug 46 with the upper shoulder 52 and aligns the lower lug 48 with the lower shoulder 54.

It will be readily appreciated that, with the lugs 46, 48 both engaged with the profile 50 and maintained in their outwardly extended positions by the mandrel 32, the plug 14 will not displace either upwardly or downwardly relative to the bore 16. Thus, when the seals 24, 26 resist a pressure differential in the bore from above to below the plug 14, the plug will not displace downwardly in the bore, and when the seals 24, 26 resist a pressure differential in the bore from below to above the plug, the plug will not displace upwardly in the bore. The pressure differential may alternate from above to below, and vice-versa, without causing displacement of the plug 14 in the bore 16.

In addition, due to the relatively large surface area contact between the lugs 46, 48 and the shoulders 52, 54 of the profile 50, relatively large pressure differentials may be resisted both from above and below the plug 14. The contact area between the lower lug 48 and the lower shoulder 54 is substantially greater than the contact area between the external shoulder 60 and the no-go shoulder. Thus, the plug 14 can resist a substantially greater pressure differential from above the plug than would be the case if only the no-go shoulder 20 prevented downward displacement of the plug.

After the mandrel 32 has been downwardly displaced by the running tool, so that the lugs 46, 48 have engaged the profile 50, the mandrel is preferably further biased downward, so that the upper lug 46 is further urged outward, thereby wedging the lugs into the profile. The inclined shoulders 56, 58 are, thus, biased outward against the respective inclined shoulders 52, 54, rather than merely being in contact therewith. In this manner, tension is applied to the wellhead 12 between the shoulders 52, 54 and compression is applied to the plug 14 between the lugs 46, 48.

This application of tension and compression in the wellhead 12 and plug 14, respectively, ensures that the lugs 46, 48 have fully engaged the profile 50 and that the plug will remain motionless in the bore 16. However, it is to be understood that it is not necessary for tension to be applied to the wellhead 12 or for compression to be applied to the plug 14 in keeping with the principles of the invention. For example, if the internal shoulders 52, 54 and the external shoulders 56, 58 each faced in a direction opposite to that as depicted in FIG. 2, then compression could be applied to the wellhead 12 and compression could be applied to the plug 14 when the lugs 46, 48 are biased outward by the mandrel 32. In fact, it is not necessary for tension or compression to be applied to either of the wellhead 12 or the plug 14, for example, if the shoulders 52, 54, 56, 58 were not inclined.

Preferably, the conical surface 36 is inclined at an angle known to those skilled in the art as a locking taper. In this way, the upper lug 46 will not be able to inwardly retract due, for example, to an upward force applied to the plug 14 by pressure from below and transmitted to the lug by the contact between the shoulders 52, 56. The friction between the upper lug 46 and the tapered surface 36 prevents the upper lug from retracting inward and prevents the mandrel 32 from displacing upward.

The surface 36 could be inclined at another angle, or not inclined at all, and the surface 42 could also be inclined, and could be inclined at a locking taper, to thereby further bias the lower lug 48 outward, without departing from the principles of the present invention.

Although only one of the upper lug 46 and one of the lower lug 48 are depicted in FIG. 2, it is to be understood that preferably there are multiple ones of each distributed radially about the plug 14. The upper and lower lugs 46, 48 are illustrated as being axially spaced apart, but they could be positioned side-by-side on the plug 14, or the upper lug could be in the position of the lower lug and vice-versa. The upper and lower lugs 46, 48 could be integrally formed with each other, so that a combined lug having the shoulders 56, 58 formed thereon could engage both the upper and lower shoulders 52, 54 of the profile 50. Therefore, it will be readily appreciated that the lugs 46, 48 may be otherwise configured and may be otherwise positioned on the plug 14, without departing from the principles of the invention.

Representatively illustrated in FIG. 3 is another wellhead plug 70 embodying principles of the present invention. The plug 70 is depicted installed and set in a bore 72 of a wellhead 76. The plug 70 is similar in many respects to the plug 14 described above, but differs in at least one significant respect in that it utilizes a single circular cross-section ring 74 to engage a profile 78 formed internally on the bore 72.

In operation, the plug 70 is lowered into the bore 72 until it contacts a no-go shoulder 80 formed internally on the bore 72. At this point, a metal to metal seal 82 carried on the plug 70 has sealingly engaged the bore 72. The plug 70 is then prevented from displacing upwardly or downwardly in the bore 72 by outwardly extending the ring 74 so that it contacts both an upwardly facing inclined shoulder 84 and a downwardly facing inclined shoulder 86 of the profile 78.

The ring 74 is preferably C-shaped, so that it may be readily extended outwardly from the plug 70, for example, by displacing a mandrel similar to the mandrel 32 described above within the plug. However, it is to be clearly understood that other types of rings or other lugs may be used, and other ways of extending the ring or lug outward may be used, in keeping with the principles of the invention.

As described above, the ring 74 engages separate opposing shoulders 84, 86 of the profile 78. However, the profile 78 could instead have a semi-circular cross-sectional shape which is complementary to the shape of the ring 74. In that case, the opposing shoulders 84, 86 would be integrally or continuously formed on the profile 78. Thus, it will be understood that the profile 78, and the profile 50 depicted in FIG. 1, could have any of a variety of shapes, in keeping with the principles of the present invention.

Of course, a person skilled in the art would, upon a careful consideration of the above description of representative embodiments of the invention, readily appreciate that many other modifications, additions, substitutions, deletions, and other changes may be made to this specific embodiment, and such changes are contemplated by the principles of the present invention. For example, although the mandrel 32 is used in the plug 14 as an extender mechanism to outwardly extend the lugs 46, 48, other types of extender mechanisms could be used. As another example, although the lugs 46, 48 of the plug 14 as described above extend outward simultaneously when the plug 14 is set in the wellhead 12, the lugs could instead extend outwardly in succession. Accordingly, the foregoing detailed description is to be clearly understood as being given by way of illustration and example only, the spirit and scope of the present invention being limited solely by the appended claims and their equivalents.

What is claimed is:

1. A wellhead plug system, comprising:

a wellhead having first and second oppositely facing shoulders internally formed on a bore extending in the wellhead; and a plug sealingly received in the bore, the plug including at least one radially outwardly extendable first lug engaging the first shoulder and preventing displacement of the plug relative to the bore in a first direction, and at least one radially outwardly extendable second lug engaging the second shoulder and preventing displacement of the plug relative to the bore in a second direction opposite to the first direction, the first lug engaging the first shoulder while the second lug is engaged with the second shoulder.

2. The system according to claim 1, further comprising a metal to metal seal between the plug and the bore.

3. The system according to claim 1, wherein the plug remains motionless relative to the bore in response to an alternating pressure differential across the plug in the bore.

4. The system according to claim 1, wherein the plug further includes a mandrel, displacement of the mandrel causing radial displacement of the first and second lugs relative to the bore.

5. The system according to claim 4, wherein axial displacement of the mandrel causes engagement of the first and second lugs with the respective first and second shoulders.

6. The system according to claim 1, wherein the wellhead further includes a no-go shoulder internally formed on the bore, the no-go shoulder engaging an external shoulder on the plug and preventing displacement of the plug through the bore prior to engagement of the first and second lugs with the respective first and second shoulders.

7. The system according to claim 6, wherein the engagement of the no-go shoulder with the plug external shoulder aligns the first and second lugs with the respective first and second shoulders.

8. A wellhead plug for sealing engagement with a wellhead having first and second oppositely facing shoulders internally formed on a bore extending in the wellhead, the plug comprising:

at least one radially outwardly extendable first lug engageable with the first shoulder for preventing displacement of the plug relative to the bore in a first direction; and at least one radially outwardly extendable second lug engageable with the second shoulder for preventing displacement of the plug relative to the bore in a second direction opposite to the first direction, and wherein the first lug is engageable with the first shoulder while the second lug is engaged with the second shoulder.

9. The plug according to claim 8, further comprising a metal to metal seal carried on the plug for sealing engagement with the bore.

10. The plug according to claim 8, wherein the first and second lugs are simultaneously extendable outward from the plug.

11. The plug according to claim 8, further comprising a mandrel, the first and second lugs radially displacing in response to displacement of the mandrel.

12. The plug according to claim 11, wherein axial displacement of the mandrel causes simultaneous radial displacement of the first and second lugs.

13. The plug according to claim 11, wherein the first lug ceases to extend radially outward when the mandrel has displaced a predetermined distance, and the second lug extending further outward when the mandrel is displaced greater than the predetermined distance.

14. The plug according to claim 8, wherein the wellhead further includes a no-go shoulder internally formed on the bore, and the plug further comprising an external shoulder formed thereon and operative to engage the no-go shoulder and prevent displacement of the plug through the bore prior to engagement of the first and second lugs with the respective first and second shoulders.

15. The plug according to claim 14, wherein the first and second lugs are aligned with the respective first and second shoulders when the no-go shoulder is engaged with the plug external shoulder.

16. The plug according to claim 8, wherein the first and second lugs are outwardly extendable independently of each other.

17. The plug according to claim 8, wherein the first and second lugs have oppositely facing respective third and fourth shoulders formed thereon, the third shoulder contacting the first shoulder while the fourth shoulder contacts the second shoulder.

18. The plug according to claim 17, wherein the first, second, third and fourth shoulders are laterally inclined, so that the plug is in a selected one of tension and compression between the first and second lugs when the first and second lugs are biased into engagement with the respective first and second shoulders.

19. A plug for sealing engagement within a bore having first and second oppositely facing shoulders internally formed thereon, the plug comprising:

first and second outwardly extendable lugs, the first lug being engageable with the first shoulder while the second lug is engaged with the second shoulder to thereby prevent displacement of the plug relative to the bore in response to a pressure differential across the plug in the bore; and an extender mechanism operative to extend the first and second lugs outward.

20. The plug according to claim 19, further comprising a metal to metal seal carried on the plug for sealing engagement with the bore.

21. The plug according to claim 19, wherein the first and second lugs are simultaneously extendable outward by the extender mechanism.

22. The plug according to claim 19, wherein the extender mechanism includes a mandrel, the first and second lugs extending outward in response to displacement of the mandrel.

23. The plug according to claim 22, wherein axial displacement of the mandrel causes simultaneous radial displacement of the first and second lugs.

24. The plug according to claim 22, wherein the first lug ceases to extend outward when the mandrel has displaced a predetermined distance, and the second lug extending further outward when the mandrel is displaced greater than the predetermined distance.

25. The plug according to claim 19, wherein the bore further includes a no-go shoulder internally formed thereon, and the plug further comprising an external shoulder formed thereon and operative to engage the no-go shoulder and prevent displacement of the plug through the bore prior to engagement of the first and second lugs with the respective first and second shoulders.

26. The plug according to claim 25, wherein the first and second lugs are aligned with the respective first and second shoulders when the no-go shoulder is engaged with the plug external shoulder.

27. The plug according to claim 19, wherein the first and second lugs are outwardly extendable by the extender mechanism independently of each other.

28. The plug according to claim 19, wherein the first and second lugs have oppositely facing respective third and fourth shoulders formed thereon, the third shoulder contacting the first shoulder while the fourth shoulder contacts the second shoulder.

29. The plug according to claim 28, wherein the first, second, third and fourth shoulders are laterally inclined, so that the plug is in a selected one of tension and compression between the first and second lugs when the first and second lugs are biased into engagement with the respective first and second shoulders.

30. A plug for sealing engagement within a bore having opposing shoulders internally formed thereon, the plug comprising:

at least one lug which extends outwardly from the plug and engages the opposing shoulders, thereby preventing displacement of the plug in first and second opposite axial directions relative to the bore.

31. The plug according to claim 30, wherein the lug is a single member.

32. The plug according to claim 30, wherein there are multiple ones of the lugs.

33. The plug according to claim 32, wherein separate ones of the lugs engage respective separate ones of the shoulders.

34. The plug according to claim 30, further comprising a metal to metal seal, the lug preventing movement of the metal to metal seal relative to the bore.

35. The plug according to claim 30, further comprising an external shoulder for engaging a no-go shoulder formed on the bore.

36. The plug according to claim 35, wherein the plug is configured so that the external shoulder engages the no-go shoulder prior to extending the lug outward into engagement with the opposing shoulders.

37. The plug according to claim 35, wherein the lug engages one of the opposing shoulders at a first contact area to prevent displacement of the plug relative to the bore in the first direction, wherein the external shoulder engages the no-go shoulder at a second contact area to prevent displacement of the plug relative to the bore in the first direction, and wherein the first contact area is greater than the second contact area.

38. The plug according to claim 35, wherein the lug is biased outwardly into simultaneous engagement with both of the opposing shoulders.

39. A method of installing a plug in a bore of a wellhead, the method comprising the steps of:

engaging an external shoulder of the plug with a no-go shoulder formed on the bore; and then outwardly extending at least one lug of the plug into engagement with opposing shoulders of a profile formed on the bore, thereby preventing displacement of the plug in first and second opposite axial directions relative to the bore.

40. The method according to claim 39, wherein the extending step further comprises extending only a single lug member into engagement with the opposing shoulders.

41. The method according to claim 39, wherein the extending step further comprises extending multiple lugs into engagement with the opposing shoulders.

42. The method according to claim 41, wherein the extending step further comprises extending separate ones of the lugs into engagement with respective separate ones of the shoulders.

43. The method according to claim 39, further comprising the step of sealingly engaging a metal to metal seal with the bore.

44. The method according to claim 43, wherein the extending step further comprises preventing displacement of the metal to metal seal in the first and second directions relative to the bore.

45. The method according to claim 39, wherein the extending step further comprises engaging the lug with one of the opposing shoulders at a first contact area to prevent displacement of the plug relative to the bore in the first direction, wherein the external shoulder engaging step further comprises engaging the external shoulder with the no-go shoulder at a second contact area to prevent displacement of the plug relative to the bore in the first direction, and wherein the first contact area is greater than the second contact area.

46. The method according to claim 39, wherein the extending step further comprises biasing the lug outward to simultaneously engage both of the opposing shoulders.

* * * * *